US009854849B2

(12) United States Patent
Tesser et al.

(10) Patent No.: US 9,854,849 B2
(45) Date of Patent: Jan. 2, 2018

(54) STRETCHABLE SHIRT COLLAR

(71) Applicant: Precision Custom Coatings, LLC, Totowa, NJ (US)

(72) Inventors: Scott Tesser, Englewood, NJ (US); Katsuhiko Matsuura, Hong Kong (CN)

(73) Assignee: Precision Custom Coatings, LLC, Totowa, NJ (US)

( * ) Notice: Subject to any disclaimer, the term of this patent is extended or adjusted under 35 U.S.C. 154(b) by 0 days.

(21) Appl. No.: 15/419,409

(22) Filed: Jan. 30, 2017

(65) Prior Publication Data

US 2017/0231288 A1 Aug. 17, 2017

Related U.S. Application Data

(60) Provisional application No. 62/294,696, filed on Feb. 12, 2016.

(51) Int. Cl.
*A41B 3/00* (2006.01)

(52) U.S. Cl.
CPC ..... *A41B 3/00* (2013.01); *A41B 2500/10* (2013.01)

(58) Field of Classification Search
CPC ..... A41B 3/00; A41B 3/06; A41B 3/10
See application file for complete search history.

(56) References Cited

U.S. PATENT DOCUMENTS

| | | | | | |
|---|---|---|---|---|---|
| 1,640,805 | A * | 8/1927 | Rabell | A41B 3/00 | 2/131 |
| 2,435,509 | A * | 2/1948 | Pfeffer, Jr. | A41B 3/00 | 2/131 |
| 2,601,035 | A * | 6/1952 | Liebowitz | A41B 3/06 | 112/441 |
| 3,024,467 | A * | 3/1962 | Sommer | A41B 3/06 | 2/131 |
| 3,333,280 | A * | 8/1967 | Hynek | A41B 3/10 | 112/475.09 |
| 2005/0160520 | A1* | 7/2005 | Forrest | A41B 3/06 | 2/255 |
| 2012/0151660 | A1* | 6/2012 | Savenok | A41D 27/06 | 2/255 |

FOREIGN PATENT DOCUMENTS

| | | | | |
|---|---|---|---|---|
| GB | 521805 A * | 5/1940 | A61B 3/10 |
| GB | 829510 A * | 3/1960 | A61B 3/06 |
| GB | 870850 A * | 6/1961 | A61B 3/00 |

* cited by examiner

*Primary Examiner* — Shaun R Hurley
*Assistant Examiner* — Andrew W Sutton
(74) *Attorney, Agent, or Firm* — Greenberg Traurig, LLP

(57) ABSTRACT

A stretchable shirt collar includes an inner collar band and an outer collar band. The inner collar band includes an exposed layer and a hidden layer. A stretchable inner collar interlining is disposed intermediate the exposed layer and the hidden layer of the inner collar band, and is fused to the exposed layer. The outer collar band includes an exposed layer and a hidden layer. A stretchable outer collar interlining is disposed intermediate the exposed layer and the hidden layer of the outer collar band, and is fused to the exposed layer. The stretchable inner collar interlining and the stretchable outer collar interlining comprise a layer of knit interlock fabric laminated to a layer of stretchable film adhesive. The elements of the stretchable shirt collars are sewn together with stretchable thread.

7 Claims, 4 Drawing Sheets

STRETCHABLE SHIRT COLLAR

CROSS-REFERENCE TO RELATED APPLICATION

The present application is a Section 111(a) application that relates to and claims the benefit of U.S. Provisional Application No. 62/294,696, filed Feb. 12, 2016, the entire disclosure of which is hereby incorporated by reference herein.

FIELD OF THE INVENTION

The exemplary embodiments relate generally to stretchable shirt collars, and, more particularly, to stretchable shirt collars including a stretchable interlining.

BACKGROUND OF THE INVENTION

Men and women typically wear collared shirts in a variety of situations when a formal, dressy, or otherwise upscale appearance is desired. However, collared shirts may be uncomfortable to some wearers due to factors such as tightness. This may particularly be the case with men's dress shirts, which are typically worn buttoned closely around the neck, often with a necktie, and have collars that are typically sized in half-inch increments. In the case of such shirts, a small increase in the size of the wearer's neck from the time of sizing and purchase to the time of wearing may cause significant discomfort to the wearer.

SUMMARY OF THE INVENTION

The stretchable shirt collars of the exemplary embodiments include an inner collar band and an outer collar band. The inner collar band includes an exposed layer and a hidden layer. A stretchable inner collar interlining is disposed between the exposed layer and the hidden layer of the inner collar band, and is fused to the exposed layer. The outer collar band includes an exposed layer and a hidden layer. A stretchable outer collar interlining is disposed between the exposed layer and the hidden layer of the outer collar band, and is fused to the exposed layer. Each of the stretchable inner collar interlining and the stretchable outer collar interlining comprises a layer of knit interlock fabric laminated to a layer of stretchable film adhesive. In an embodiment, the elements of the stretchable shirt collars are sewn together with stretchable thread.

BRIEF DESCRIPTION OF FIGURES

For a more complete understanding of the present invention, reference is made to the following detailed description of an exemplary embodiment considered in conjunction with the accompanying drawings, in which.

DETAILED DESCRIPTION OF THE INVENTION

Figure 1:
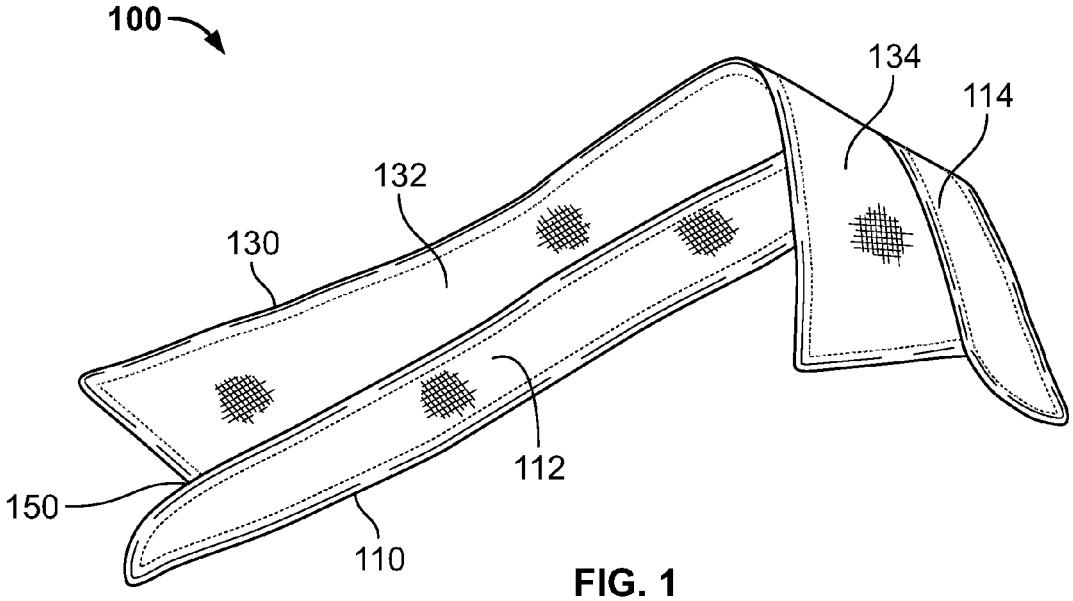
FIG. 1 shows a stretchable shirt collar according to an exemplary embodiment of the present invention.

The exemplary embodiments described herein relate to a stretchable shirt collar 100 including four portions: an inner collar band 110, an outer collar band 130, a stretchable inner collar band interlining, and a stretchable outer collar band interlining. FIG. 1 illustrates the stretchable shirt collar 100 (hereinafter "collar 100" for brevity") according to an exemplary embodiment of the present invention. The collar 100 includes the inner collar band 110 and the outer collar band 130 meeting at a junction 150. The inner collar band 110 includes an exposed layer 112 and a hidden layer 114 opposite the exposed layer 112. The outer collar band 130 includes an exposed layer 132 and a hidden layer 134 opposite the exposed layer 132. The inner collar band 110 and the outer collar band 130 are sized and shaped in a manner known in the art such that, when the collar 100 is sewn into a shirt that is subsequently worn by a wearer, the inner collar band 110 and the outer collar band 130 are folded over one another. As a result of such fold, the exposed layer 112 of the inner collar band 110 faces the wearer's neck, the exposed layer 132 of the outer collar band 130 faces away from the wearer's back such that it can be seen by individuals standing behind the wearer, and the hidden layers 114, 134 of the inner collar band 110 and the outer collar band 130, respectively, face one another and are hidden from view.

Each of the inner collar band 110 and the outer collar band 130 may be made from any fabric that is appropriate for such use (e.g., cotton, polyester, etc.). In an embodiment, the inner collar band 110 and the outer collar band 130 are made from the same fabric. In an embodiment, the inner collar band 110 and the outer collar band 130 are made from different fabrics. In an embodiment, the inner collar band 110 and the outer collar band 130 are made from a fabric that comprises spandex. In an embodiment, the inner collar band 110 and the outer collar band 130 are made from a fabric that includes at least 1% spandex by weight. The inner collar band 110 and the outer collar band 130 may be sized and shaped such that the collar 100 is any style of collar, including a standard type of collar (e.g., straight collar, spread collar, button-down collar, etc.).

Figure 2A:
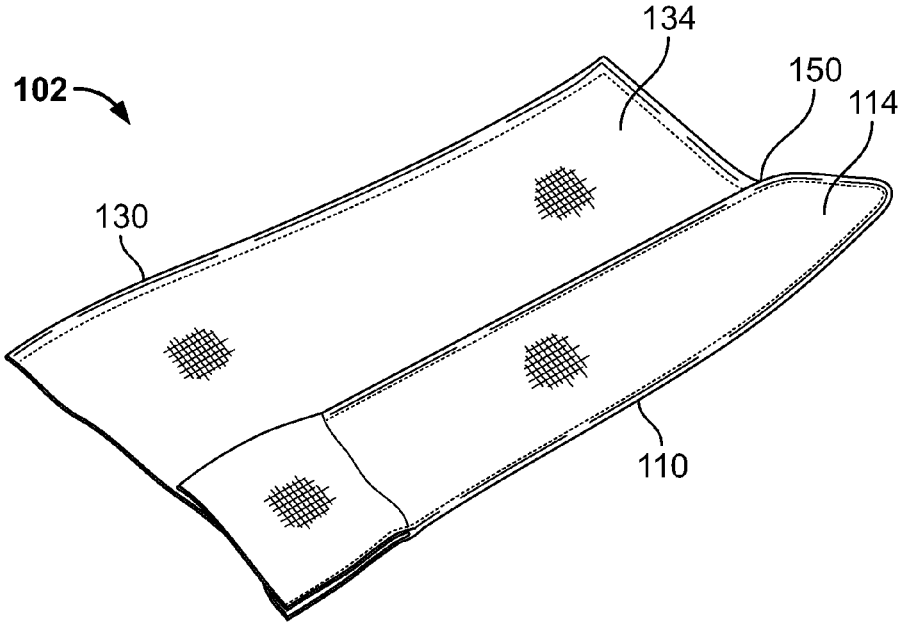
FIG. 2A shows a portion of the stretchable shirt collar of FIG. 1.

FIG. 2A illustrates a portion 102 of the collar 100 shown in FIG. 1 that has been cut away from a remainder of the collar 100. As shown in FIG. 2A, the collar 100 is not folded over and the hidden layers 114, 134 of the inner collar band 110 and the outer collar band 130, respectively, are facing upward with respect to the orientation of the collar 100 shown in FIG. 2A.

Figure 2B:
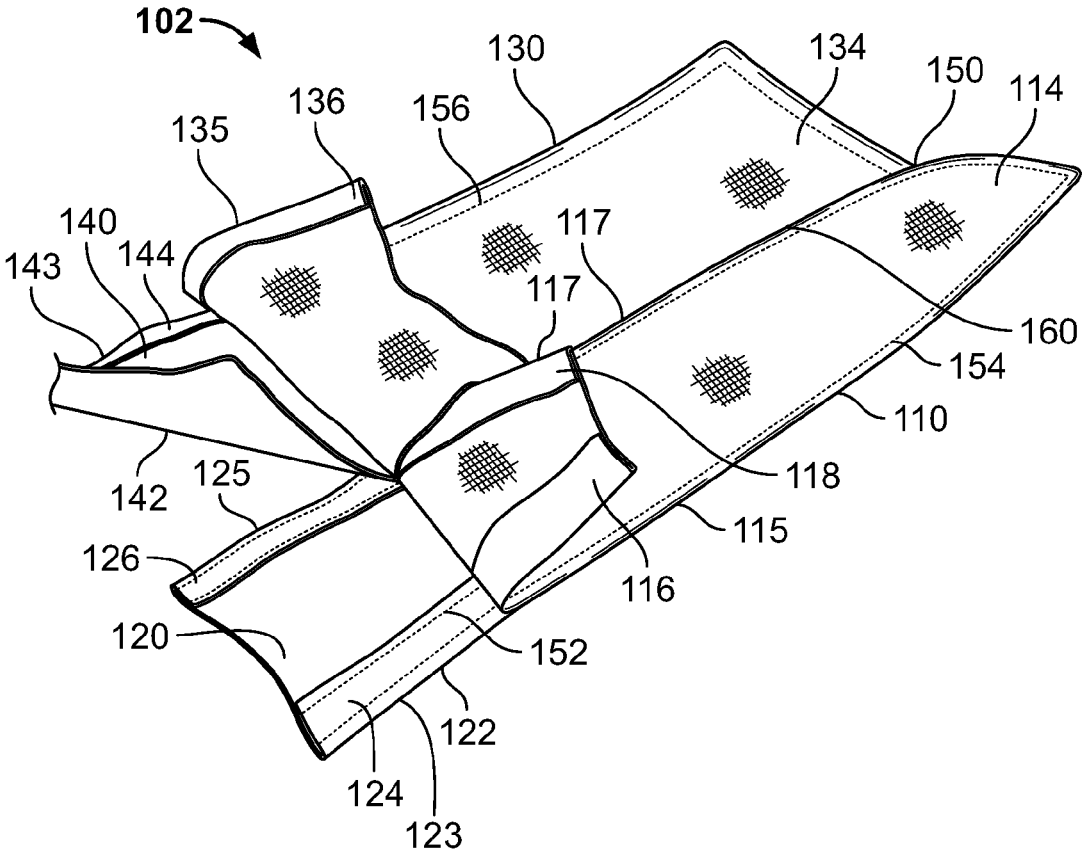
FIG. 2B shows the portion of the stretchable shirt collar shown in FIG. 2A, showing portions of fabric peeled back to show an interlining.

FIG. 2B illustrates the portion 102 of the collar 100 shown in FIG. 2A, but with segments of the hidden layers 114, 134 of the inner collar band 110 and the outer collar band 130, respectively, peeled away from the remainder of the portion 102. The hidden layer 114 of the inner collar band 110 includes a first folded portion 116 extending along a first, outer edge 115 thereof, and a second folded portion 118 extending along a second, inner edge 117 thereof opposite the first outer edge 115. The hidden layer 134 of the outer collar band 130 includes a folded portion 136 extending along a first, outer edge 135.

The inner collar band 110 has a stretchable inner collar band interlining 120 positioned intermediate the exposed layer 112 and the hidden layer 114. The outer collar band 130 includes a stretchable outer collar band interlining 140 positioned intermediate its exposed layer 132 and hidden layer 134. The stretchable inner collar band interlining 120 and the stretchable outer collar band interlining 140 are both made from a stretchable fabric 170 and a stretchable film adhesive 172. In an embodiment, the stretchable fabric 170 is a knit interlock fabric. In an embodiment, the stretchable inner collar band interlining 120 and the stretchable outer collar band interlining 140 both include the same stretchable fabric. In an embodiment, the stretchable inner collar band interlining 120 and the stretchable outer collar band interlining 140 each include different stretchable fabric. In an embodiment, as seen most clearly in FIG. 3, the stretchable inner collar band interlining 120 and the stretchable outer collar band interlining 140 are each made from the stretchable, knit interlock fabric 170 that is laminated to the stretchable film adhesive 172. Knit interlock fabric is well known to persons of ordinary skill in the relevant art and is an eight-lock knit cloth which generally resembles a double 1×1 ribbed fabric that is interknitted with crossed sinker wales. Knit interlock fabric generally has a smooth surface on both sides. In an embodiment, the stretchable, knit interlock fabric 170 is 100% polyester knit interlock fabric. In an embodiment, the stretchable film adhesive 172 is a thermoplastic elastomer that is capable of being stretched with about 100% recovery to its original size and shape after being stretched. Furthermore, suitable thermoplastic elastomers are capable of being formed into a fusable film that can be fused to fabric. In some embodiments, the thermoplastic elastomer of the stretchable film adhesive comprises a thermoplastic polyurethane ("TPU") film. A TPU film acts as an adhesive and a barrier and possesses the necessary properties of stretch and recovery. In an embodiment, a TPU film of a thickness between about 1 mil (0.025 mm) and about 3 mil (0.075 mm) may be used. In an embodiment, the stretchable film adhesive 172 is laminated to one side of the stretchable, knit interlock fabric 170 to form the stretchable inner collar band interlining 120 and the stretchable outer collar band interlining 140.

Figure 3:
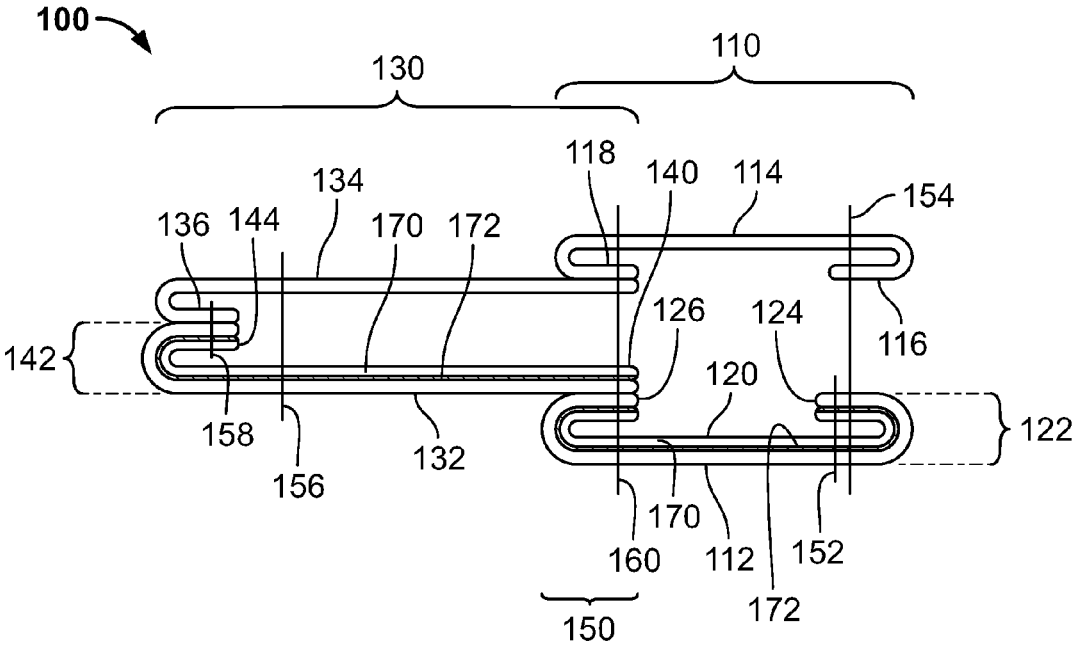
FIG. 3 schematically illustrates a cross-section of the stretchable shirt collar of FIG. 1.

In an embodiment, the stretchable inner collar band interlining 120 and the stretchable outer collar band interlining 140 are fused to the exposed layers 112, 132 of the inner collar band 110 and the outer collar band 130, respectively, by a fusing process. More particularly, the fusing process is performed with the side of the stretchable inner collar band interlining 120 or the stretchable outer collar band interlining 140 that includes the stretchable film adhesive 172 facing the corresponding one of the exposed layers 112, 132, thereby to enable adhesion therebetween. Referring now to FIG. 3, the position of the stretchable film adhesive 172 as a result of the fusing process is indicated as a thick solid line or layer.

In an embodiment, the fusing process is performed prior to any stitching of the above-noted elements of the collar 100. In an embodiment, the fusing process is performed before the exposed layers 112, 132 and the stretchable inner and outer collar band interlinings 120, 140 are cut to size and shape. The fusing process may be performed using any technique known now or in the future that securely fuses the stretchable film adhesive 172 to the stretchable fabric 170. In an embodiment, the fusing process is performed using a continuous roller press. In an embodiment, the continuous roller press is a floor-mounted continuous roller press having an intake belt width greater than 600 mm. In an embodiment, the fusing process is performed using a temperature from about 100° C. to about 170° C. In an embodiment, the fusing process is performed using an applied pressure from about 1 kilogram per square centimeter to about 5 kilograms per square centimeter. In an embodiment, the fusing process is performed for a duration of about 5 seconds to about 25 seconds.

With reference to FIG. 2B, the fusing of the exposed layer 112 of the inner collar band 110 to the stretchable inner collar band interlining 120 produces a lined inner collar band 122. The lined inner collar band 122 includes a first folded portion 124 extending along a first, outer edge 123 thereof, and a second folded portion 126 extending along a second, inner edge 125 thereof. The fusing of the exposed layer 132 of the outer collar band 130 to the stretchable outer collar band interlining 140 produces a lined outer collar band 142. The lined outer collar band 142 includes a folded portion 144 extending along a first outer edge 143 thereof. Although the stretchable inner collar band interlining 120 and the stretchable outer collar band interlining 140 are only visible in FIG. 2B in the segment where the segments of the hidden layers 114, 134 of the inner collar band 110 and the outer collar band 130, respectively, have been peeled away from the remainder of the portion 102 of the collar 100, it will be apparent to those of skill in the art that the stretchable inner collar band interlining 120 and the stretchable outer collar band interlining 140 (and, correspondingly, the lined inner collar band 122 and the lined outer collar band 142) extend over the entirety of the collar 100.

FIG. 3 schematically illustrates a cross-sectional view of the collar 100. To facilitate a clear representation of the elements of the collar 100, the view shown in FIG. 3 is not to scale. In particular, elements forming the inner collar band 110 and the outer collar band 130 are shown spaced out for clarity. It will be apparent that the seams that hold together the collar 100, which will be described in further detail hereinafter, are not shown to retain such elements in as tight proximity as would be the case in the collar 100 itself. The seams to be described hereinafter may be formed from a stretchable thread. In an embodiment, the stretchable thread is made from polybutylene terephthalate ("PBT").

With reference to the inner collar band 110, a first seam 152 extends through the lined inner collar band 122 and the first folded portion 124 thereof. A second seam 154 extends through the hidden layer 114 of the inner collar band 110, the first folded portion 116 of the hidden layer 114 of the inner collar band 110, the first folded portion 124 of the lined inner collar band 122, and the lined inner collar band 122.

With reference to the outer collar band 130, a third seam 156 extends through the hidden layer 134 of the outer collar band 130 and the lined outer collar band 142. A fourth seam 158 extends through the folded portion 136 of the hidden layer 134 of the outer collar band 130 and the folded portion 144 of the lined outer collar band 142.

With reference to the junction 150 of the inner collar band 110 to the outer collar band 130, the hidden layer 134 of the outer collar band 130 and the lined outer collar band 142 are adjacent to one another and placed between, to one side, the second folded portion 118 of the hidden layer 114 of the inner collar band 110 and, to the other side, the second folded portion 126 of the lined inner collar band 122. A fifth seam 160 extends through the hidden layer 114 of the inner collar band 110, the second folded portion 118 of the hidden layer 114 of the inner collar band 110, the hidden layer 134 of the outer collar band 130, the lined outer collar band 142, the second folded portion 126 of the lined inner collar band 122, and the lined inner collar band 122. It may be seen that the fifth seam 160 binds together the inner collar band 110 and the outer collar band 130, including all the various elements thereof, and thereby forms the junction 150.

It will be apparent to those of skill in the art that the specific arrangement of folds and seams described above is only exemplary. In other embodiments, other arrangements of folds and seams may be used to form the collar 100. As one alternative example, an additional seam may extend alongside the fifth seam 160 to provide reinforcement to the junction 150. As another alternative example, an additional seam may extend alongside the third seam 156 to provide an ornamental appearance to the outer collar band 130. In an embodiment, the seams described above may be sewn from thread that is the same color as the fabric forming the inner collar band 110 and the outer collar band 130. In an embodiment, the seams described above may be sewn from thread that is a contrasting color to the fabric forming the inner collar band 110 and the outer collar band 130.

The exemplary collar 100 provides a stretchable collar that may be used in connection with any desired type of shirt, including, but not limited to, men's dress shirts. Depending on the specific materials used in the exemplary collar 100 (e.g., the fabric used to the exposed layers 112, 132 and the hidden layers 114, 134 of the inner collar band 110 and the outer collar band 130, respectively), the degree to which the exemplary collar 100 is capable of stretching may vary. For example, in various embodiments, the exemplary collar 100 may be capable of stretching by about 3% to about 10% (i.e., stretching to between 103% and 110% of its original size) and subsequently recovering its original size and shape.

Figure 4A:
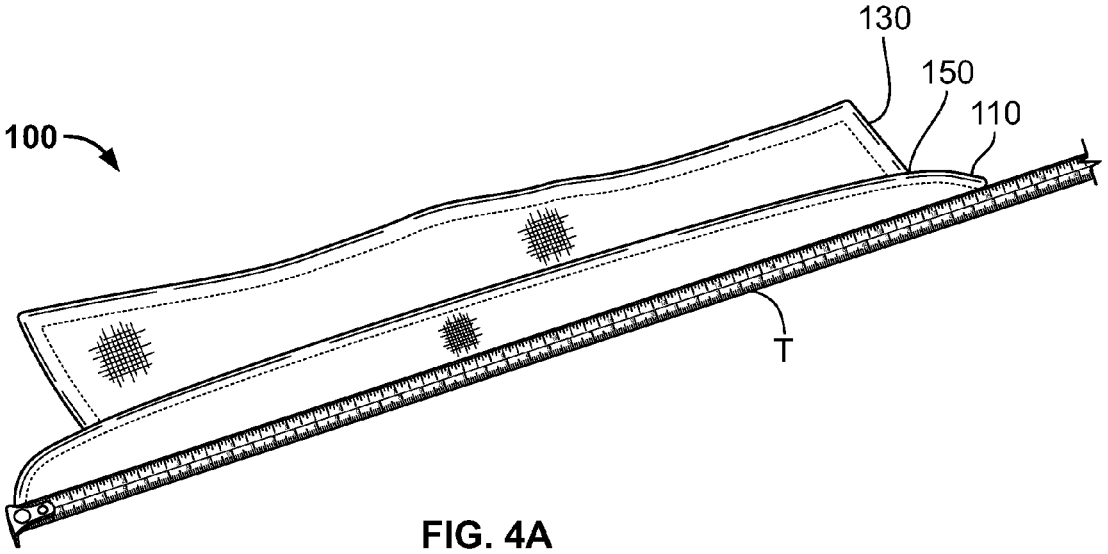
FIG. 4A shows the stretchable shirt collar of FIG. 1 in an unstretched state and alongside a tape measure indicating its unstretched size.
Figure 4B:
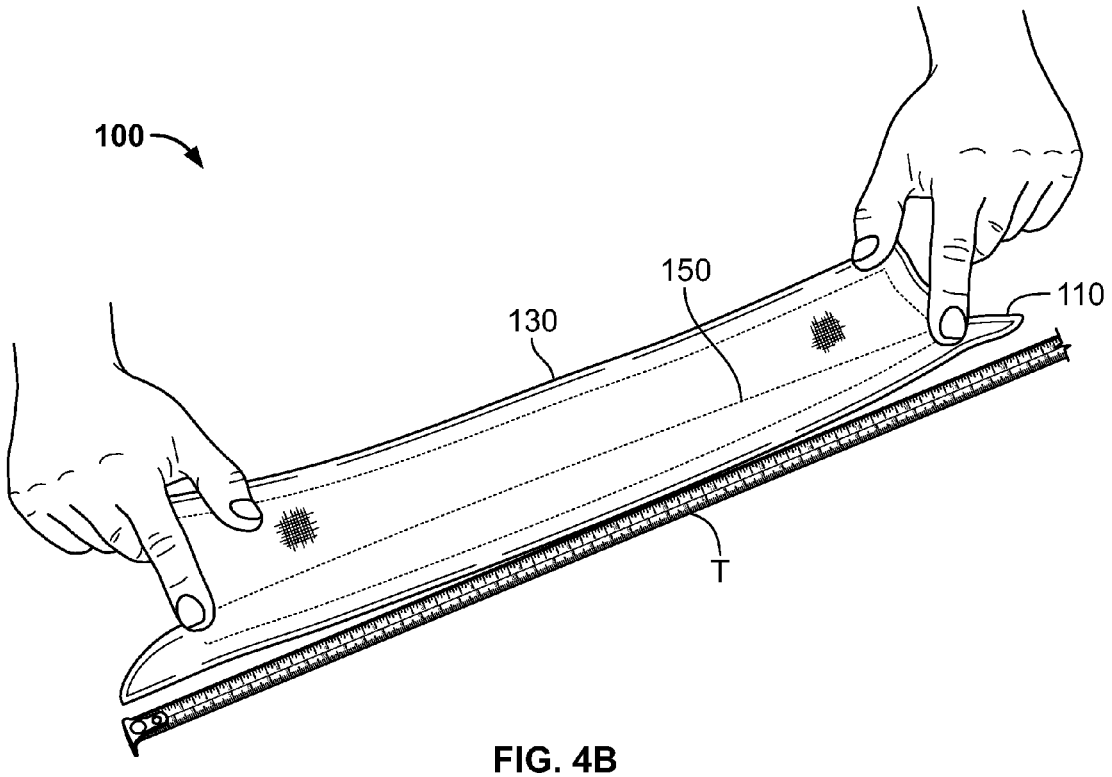
FIG. 4B shows the stretchable shirt collar of FIG. 4A in a stretched state and alongside the tape measure indicating its stretched size.

FIG. 4A shows the exemplary collar 100 in a relaxed (i.e., unstretched) state and in proximity to a tape measure T. It may be seen that the length of the inner collar band 110 is 18 inches (i.e., that the collar 100 is sized for use as an element of a men's dress shirt having an 18 inch neck measurement). FIG. 4B shows the exemplary collar 100 of FIG. 4A in a stretched state and in proximity to the tape measure T. It may be seen that the stretched length of the inner collar band 110 is about 18.5 inches. In other words, the exemplary collar 100 is capable of stretching by about 3%.

It should be understood that the embodiments of the invention described herein are merely exemplary and that a person skilled in the art may make many variations and modifications without departing from the spirit and scope of the invention. All such variations and modifications are intended to be included within the scope of the invention as defined herein.

The invention claimed is:

1. A shirt collar, comprising:

an inner collar band having an exposed layer and a hidden layer;

a stretchable inner collar interlining disposed intermediate the exposed layer and the hidden layer of the inner collar band;

an outer collar band having an exposed layer and a hidden layer; and a stretchable outer collar interlining disposed intermediate the exposed layer of the outer collar band and the hidden layer of the outer collar band, wherein each of the inner collar interlining and the outer collar interlining includes a stretchable fabric and a stretchable film adhesive that are fused to one another.

2. The shirt collar of claim 1, wherein the inner collar interlining is fused to the exposed layer of the inner collar band.

3. The shirt collar of claim 1, wherein the outer collar interlining is fused to the exposed layer of the outer collar band.

4. The shirt collar of claim 1, wherein the stretchable film adhesive includes a thermoplastic elastomer capable of being stretched, of 100% recovery to its original size and shape after being stretched, and of being formed into a fusable film.

5. The shirt collar of claim 4, wherein the thermoplastic elastomer comprises thermoplastic polyurethane.

6. The shirt collar of claim 1, wherein the stretchable fabric is a knit interlock fabric.

7. The shirt collar of claim 1, wherein the exposed layer of the inner collar band and the hidden layer of the inner collar band are stitched together with a stretchable thread, and the exposed layer of the outer collar band and the hidden layer of the outer collar band are stitched together with a stretchable thread.

* * * * *